United States Patent [19]

Ehrnström et al.

[11] Patent Number: 4,737,207

[45] Date of Patent: Apr. 12, 1988

[54] METHOD FOR THE PREPARATION OF A WATER-IN-OIL TYPE EMULSION EXPLOSIVE AND AN OXIDIZER COMPOSITION FOR USE IN THE METHOD

[75] Inventors: Hans Ehrnström, Gyttorp; Gunnar Ekman, Nora, both of Sweden

[73] Assignee: Nitro Nobel AB, Gyttorp, Sweden

[21] Appl. No.: 940,353

[22] Filed: Dec. 11, 1986

[30] Foreign Application Priority Data

Dec. 23, 1985 [SE] Sweden ..... 8506119

[51] Int. Cl.[4] ..... C06B 45/00

[52] U.S. Cl. ..... 149/2; 149/21; 149/109.6

[58] Field of Search ..... 149/2, 109.6, 21

[56] References Cited

U.S. PATENT DOCUMENTS

| | | | |
|---|---|---|---|
| 3,397,097 | 8/1968 | Atadan et al. | 149/46 |
| 3,706,607 | 12/1972 | Chrisp | 149/2 |
| 3,711,345 | 1/1975 | Tomic | 149/22 |
| 3,713,919 | 1/1973 | Tomic | 149/47 |
| 3,770,552 | 11/1973 | Lacam | 156/510 |
| 3,790,415 | 2/1974 | Tomic | 149/2 |
| 4,008,108 | 2/1977 | Chrisp | 149/2 |
| 4,138,281 | 2/1979 | Olney et al. | 149/2 |
| 4,310,364 | 1/1982 | Ekman et al. | 149/2 |
| 4,338,146 | 7/1982 | Granlund | 149/109.6 |
| 4,410,378 | 10/1983 | Hattori et al. | 149/109.6 |
| 4,472,215 | 9/1984 | Binet et al. | 149/109.6 |
| 4,491,489 | 1/1985 | Ellis et al. | 149/109.6 |
| 4,500,370 | 2/1985 | Hajto | 149/109.6 |
| 4,511,412 | 4/1985 | Kakino et al. | 149/109.6 |
| 4,511,414 | 4/1985 | Matsui et al. | 149/109.6 |
| 4,525,225 | 6/1985 | Cechanski | 149/109.6 |
| 4,615,752 | 10/1986 | Miller | 149/109.6 |

FOREIGN PATENT DOCUMENTS

| | | |
|---|---|---|
| 0123388 | 10/1984 | European Pat. Off. . |
| 117580 | 7/1968 | Norway . |
| 437259 | 2/1981 | Sweden . |

*Primary Examiner*—Stephen J. Lechert, Jr.

*Attorney, Agent, or Firm*—Burns, Doane, Swecker & Mathis

[57] ABSTRACT

A method and an oxidizing composition for preparation of a water-in-oil type emulsion explosive in which a pre-emulsion is formed from a fuel phase and a first part of an oxidizer phase, an oxidizing composition is prepared between a second part of the oxidizer phase and a void containing or void generating material for the explosive whereafter the pre-emulsion and the mixture are emulsified to form the final emulsion.

22 Claims, No Drawings

METHOD FOR THE PREPARATION OF A WATER-IN-OIL TYPE EMULSION EXPLOSIVE AND AN OXIDIZER COMPOSITION FOR USE IN THE METHOD

BACKGROUND

The present invention relates to the art of blasting, and more particularly to a method for preparation of a water-in-oil type emulsion explosive, having a discontinuous hydrophilic oxidizer phase, containing oxidizing salts, dispersed in a continuous lipophilic fuel phase, containing combustible materials, and being sensitized by voids dispersed in the emulsion.

In the manufacture of this kind of explosives the introduction of the voids presents a number of problems. The size of the voids must be controlled, since too small voids are unable to locally ignite the fuel/oxidizer mixture while too large voids reduce either the number of ignition points or the energy concentration in the explosive as a whole. A homogeneous distribution of the voids is essential since local deficiencies may leave unreacted material after detonation and even cause a termination of the detonation wave if the unsensitized area is large. In general it also is necessary that void structure and distribution are stable over time and resistant to dead pressing and emulsion deformation. The void introduction process itself is complicated by the great component density difference. All these problems will be more pronounced in site manufacture of bulk explosives where condition control cannot reach factory standards, simpler mixing devices have to be used and safety requires late but rapid density reduction.

Several methods are known for introducing voids in emulsion explosives.

Air or other gases can be mechanically worked into the emulsion during or after its manufacture. It is difficult to disintegrate the gas into fine enough bubbles and simple mixing devices are generally not sufficient. Long term stability is affected by partial dissolution of the free gas, by coalescence of bubbles or by escape of gas, especially when working or deforming the emulsion.

Several suggestions have been made for in situ formation of occluded gas in the emulsion by the use of gassing agents, see for example U.S. Pat. Nos. 3,706,607, 3,711,345, 3,713,919, 3,770,552, 3,790,415, and 4,008,108. Common problems with these known methods are difficulties with dosage and distribution of the normally quite small gassing agent additive in the emulsion. Good timing between gassing and mixing is required. In bulk manufacture problems are frequently encountered in timing gassing reaction against charging operation and in halting the reaction at charging interruptions.

Adding cellular or void containing materials in the emulsions has the advantage of isolating the voids from the emulsion matrix whereby durability and mechanical resistance is improved in relation to free gas bubbles. Rapid and simple introduction of these materials in an emulsion matrix is difficult, however, due to the fragile nature of the particles and the tendency of the fine, light and dusty material to resist wetting and entrain an uncontrolled amount of additional air into the emulsion. The U.S. Pat. Nos. 4,310,364 and 4,338,146 disclose manufacturing methods in which cellular particles are added to a salt solution before fuel phase addition. The method requires an extended agitation to convert an oil-in-water emulsion into a water-in-oil emulsion and during a substantial part of the manufacturing process a gas sensitized explosive will be present.

SUMMARY OF THE INVENTION

A main object of the present invention is to avoid the afore-mentioned problems. More specifically, an object of the invention is to provide a method by which voids can be introduced rapidly and by simple means at a late stage in the explosive preparation. Another object is to allow introduction of voids at a low or ambient temperature. Yet another object is to provide a preparation method suitable for on-site manufacture of bulk explosive. A further object is to allow preparation of sensitized explosive at a variable output and in close accord with charging requirements. The invention also has for an object to provide an oxidizer composition suitable for use in the method.

These objects are reached by the characteristic features stated in the claims.

According to the present invention a pre-emulsion is formed from the fuel phase and a first part of the oxidizer phase whereupon the void containing or void generating material for the entire emulsion together with a second part of the oxidizer phase, together forming a second oxidizer composition, are mixed with the pre-emulsion. The pre-emulsion lacks sensitizing voids and has a strongly negative oxygen balance and accordingly is a safe non-explosive composition. The pre-emulsion is stable due to the homogenous density of its constituents and its surplus of emulsifier and fuel phase. For these reasons the pre-emulsion can be manufactured under controlled conditions, transported freely and stored for prolonged periods, all without severe safety precautions. The comparatively high fuel phase content in the pre-emulsion allows for a strong disintegration of oxidizer phase droplets, reducing mixing requirements for the second oxidizer composition in which sensitive hollow particles may be present. In the final mixing operation the pre-emulsion acts as a seed emulsion promoting a rapid formation of the desired water-in-oil type emulsion. By forming a non-explosive composition of the void providing material and a second part of the oxidizing phase several mixing problems are avoided. Homogeneous distribution of voids is facilitated by the increased volume of the void bearing stream brought into the pre-emulsion and simple mixing devices can be employed. When hollow particles are used as voids providing material the oxidizer phase component will be extended and easily emulsified in the pre-emulsion and the particles will be firmly wetted and deaerated at the mixing moment. If the second oxidizer composition has a composition of lower crystallization point than the first part, final mixing can be made at low or even ambient temperature to increase safety and strongly reduce equipment needs in this preparation stage. A low crystallization point for the second oxidizer part will also reduce mixing requirements as such, since a low risk for crystallization makes a certain frequency of large droplets of this phase in the emulsion acceptable. The viscosity properties of the second oxidizer composition make it suitable as a lubricant for the pre-emulsion in transportation of both components in a common tube or hose.

Further objects and advantages of the invention will be evident from the detailed description below.

DETAILED DESCRIPTION

The present invention can be used in connection with most emulsion explosives of the prior art. Suitable raw materials and manufacturing conditions are disclosed in the U.S. Pat. Nos. 3,447,978 and 4,110,134, both incorporated herein by reference.

The main part of the fuel phase is usually a carbonaceous oil and/or a wax component, the purpose of the latter being to increase viscosity. Other viscosity modifiers may be included, such as polymeric materials. The fuel phase must be of sufficiently low viscosity to be fluid at the preparation temperatures for both the pre-emulsion and the final emulsion. A softening temperature below 40° and preferably also below 20° C. is suitable to allow for final preparation of the emulsion at on-site ambient temperature in accordance with a preferred embodiment of the invention. In these situations an all-oil or polymer modified oil emulsion can preferably be prepared. The requirement for stable retention of the voids during the use period for the explosive puts a lower viscosity limit on the fuel phase.

A water-in-oil type emulsifier is normally included in the emulsion, such as sorbitan fatty acid esters, glycol esters, unsaturated substituted oxazolines, fatty acid salts or derivatives thereof. In the present method it is preferred to include all or substantially all the emulsifier already in the pre-emulsion, suitably as a part of the original fuel phase.

The main components of the oxidizer phase are oxidizing salts, such as inorganic nitrates and optionally also perchlorates, dissolved in a small amount of water. Preferably several oxidizing salts are included to maintain a high salt concentration in solution. In general ammonium nitrate is present in addition to alkali or alkali earth metal nitrates and perchlorates. The oxidizer phase may also contain crystallization point depressants such as urea or formamide. When emulsified to discontinuous droplets the oxidizer phase shall be kept above its crystallization point.

According to the invention the oxidizer phase is divided into two parts, a first part included in the preemulsion in a first mixing step and a second part, which is combined with void providing material and separately mixed with the pre-emulsion in a second mixing step. The oxidizer parts may well be similar in composition and conventional conditions can then be used in both emulsifying steps. A typical water content for the parts is then about 8 to 25% by weight. To compensate for a lower salt concentration in the second oxidizer phase the concentration in the first part can be increased correspondingly. A water content of only 5 to 20% by weight in the first part may require emulsifying temperatures of between 50° and 100° C. in the first step. A preferred water content in the first part is between 8 and 18% by weight. Preparation of the pre-emulsion normally requires high shear forces, such as with a Votator CR-mixer. A higher than normal disintegration degree for the discontinuous phase can be used to compensate for a less perfect mixing in the second step.

The second part of the oxidizer phase is used to complete the emulsion to a normal oxygen balance, say between +5% and −15%, and as a means for introduction of the voids in the emulsion. As said, the second part may have a conventional water content between 8 and 25% by weight, but the first and second parts need not have the same composition. The water content can for example be raised from the above said values to 100%. A preferred deviation is when the second part has a lower crystallization point than the first part. The second part can be given a lower crystallization point by use of special, non-oxidizer, additives or by use of a different salt composition, such as a greater number of different salt types or a larger amount of perchlorates. A preferred way of reducing the crystallization point, however, is to increase the water content somewhat. High water contents can be used when the second part is a smaller fraction only of the total oxidizer phase content, for example when the void producing material is a foaming agent or when only a small amount of hollow particles shall be added. In the extreme, pure water or a phase otherwise without oxidizing salts can be used. Hence a suitable water content can be between 15 and 100% by weight. Preferably, however, salt is present in the second part to limit concentration requirements for the first part and a preferred water content is between 15 and 70, and preferably between 25 and 60% by weight. Suitably the crystallization point for the second part is below 40° C. and preferably below 20° C. In general the point needs not to be reduced below −10° C. and often not even below 0° C.

Sufficient voil producing material shall be included in the second part of the oxidizer phase to yield the desired density in the final emulsion, normally between 0.9 and 1.35 g/cc or preferably between 1.0 and 1.3 g/cc. Any density reducing means able to be retained in the second part can be used. Preferred means are chemical foaming agents and hollow particles.

Chemical foaming agents give a cost-effective way of reducing emulsion density and are as a rule usable when there is not too long time lapse between manufacture and use. In the present method the agents are easily distributed rapidly and homogeneously in the emulsion by use of a non-segregating second oxidizer phase, which can be kept rather small if desired. Suitable foaming agents are disclosed in the specifications enumerated previously, such as nitroso compounds, borohydride, diisocyanates, carbonates or peroxides. The agent may be of single component type, activated by heat, in which case the agent can be included in the second oxidizer part and the pre-emulsion kept heated at the mixing moment. The agent can also be of two or multiple component type, reacting on mixing, in which case at least one of the components should be included in the second oxidizer phase and at least one in the pre-emulsion. A preferred system of this kind is based on acid and nitrite and preferably urea or thiourea. Acid can be included in the preemulsion, nitrite in the second oxidizer part and urea or thiourea in either but preferably in the second oxidizer part. Also in multiple component systems reaction speed can be increased by heating the ready emulsion, the second oxidizer part or preferably by keeping the pre-emulsion heated at the mixing moment.

Density reduction with hollow particles gives stable emulsion properties, good control of void size and a certain mechanical resistance. Mixing problems are avoided in the present process by incorporation of the particles in the second oxidizer part, as described, and their presence also alters the consistency of the second part to better correspondence with the pre-emulsion viscosity. Suitable particles are known in the art. They may be organic such as porous plastic materials ground to suitable size or phenolformaldehyde microspheres but are preferably discrete thermoplastic microspheres based on a vinylidene chloride containing monomer mixture, e.g. Expancel®. Generally inorganic hollow particles are more rigid. Porous glass materials such as perlite ground to suitable size may be used but discrete spheres are preferred, for example C 15/250 from 3M Company or Q-cell 575 from PQ Corporation. The void size should be in the range from a few microns to a few hundred microns and is preferably in the range between 10 and 150 microns. Too thick-walled particles should be avoided and preferably the bulk density does not exceed 0.1 for organic and 0.4 g/cc for inorganic spheres. The lower limit is determined by the strengh requirements in each application.

When hollow particles are added as a density reducing agent, a suitable second oxidizer composition according to the invention will contain all or substantially all the void material for the final emulsion. Hollow particles have the advantage of adding substantial volume to the second oxidizer composition without affecting the crystallization properties for either the first or the second oxidizer parts. The void content is suitably above 30% by volume, better is above 40 and preferably the content exceeds 50% by volume. The viscosity will in general be too high if the content is above 95% by volume and preferably the second oxidizer composition does not contain more than 90% by volume. Often a suitable water content does not exceed 70% by volume.

Final mixing is facilitated by near equal volumes for pre-emulsion and second oxidizer composition. The second oxidizer composition should represent at least 10, better at least 20 and preferably at least 30% by volume of the entire emulsion. No advantages are seen in using more than 70%, and if the second oxidizer composition shall be included at low temperatures, preferably not more than 60% by volume of the entire emulsion should be the second oxidizer composition.

Similarly, mixing is facilitated by near equal viscosity properties for pre-emulsion and second oxidizer composition, determined at the respective temperatures for the components at the mixing moment. In general the second oxidizxer composition has the lower viscosity. It can be increased by proper selection of salt to hollow particle amounts within the above said limits or by thickening additives such as guar gum, other natural gums etc. Hollow particle segregation is also prolonged in a thickened liquid. Preferably the mutual component deviation in viscosity is not more than 50000 or better not more than 25000 mPa.s(cP) at mixing.

As initially discussed, final mixing can be effected in quite simple mixing devices. High shear mixers can be used also in this step but low shear mixing is efficient and preferred. Static mixers are suitable, especially in bulk manufacture where the mixer can be positioned at the end of the charging tube. If the components are fed separately to a mixing device in the end of a charging tube an explosive will not be present anywhere in the manufacturing equipment but immediately before ejecting the final mixture from the mixer into the borehole. No explosive material will be present to transmit an accidental detonation at the charging point via charging tube or otherwise to the main bulk unit. A preferred way of delivering the components separately in a single tube is to feed the pre-emulsion centrally, surrounded by the second oxidizer part since the latter has suitable flow properties as lubricant, especially when containing the discrete inorganic low density microsphere particles. The concentric feeding pattern can be achieved by central and annular orifices at the tube inlet.

The final emulsion can be conventional in composition, e.g. comprise about 3 to 10% by weight of fuel including an emulsifier, about 8 to 25% by weight of water, about 50 to 86% by weight of oxidizing salts and about 0 to 20% by weight of an auxiliary fuel, such as aluminium, or other additives. Fillers can be included, either inert or e.g. sodium chloride to modify emulsion incandescent properties. Particulate fillers are preferably included in the pre-emulsion after its preparation.

Normally the bulk emulsions produced are non-capsensitive but it is fully possible also to produce capsensitive emulsions, i.e. emulsions detonable with a number 8 cap in charge diameters of 32 mm or less.

The invention will be further illustrated by the following examples.

EXAMPLE 1

A solution was prepared from 48.28 kg ammonium nitrate (AN), 9.79 kg sodium nitrate (SN) and 9.32 kg of water. The solution had a crystallization temperature of 70° C. and was held at 75° C. when emulsified into a fuel phase consisting of 4.59 kg of a mineral oil with 1.0 kg emulsifier, sorbitanmonooleate, dissolved therein. The temperature of the fuel phase was also 75° C. and as emulsifying equipment a Votator CR-mixer was used. The viscosity of the resulting pre-emulsion was about 40000 mPa.s at 20° C.

Another salt solution was prepared from 9.32 kg water, 9.32 kg AN and 5.59 kg SN. This salt solution had a crystallization point below 0° C. In this solution 2.8 kg of inorganic microspheres (C 15/250 sold by 3M Company) having a density of about 150 kg/m$^3$ were suspended and kept in suspension by use of a stirrer of propeller type.

The volume ratio between the pre-emulsion and the suspension was about 60/40 and the latter was emulsified into the former by mixing the components in a ribbon mixer at about 20° C. and at a mixer speed of about 50 to 60 rpm, resulting in an emulsion explosive having a density of 1.07 g/cc. The emulsion was sensitive to a number 8 cap in 25 mm diameter and had a velocity of detonation of 4260 m/s.

EXAMPLE 2

Example 1 was repeated but with only 2.0 kg of the same microspheres in the suspension, giving a final density of 1.17 g/cc. The emulsion was detonated at a velocity of 4800 m/s in a 39×550 mm PVC tube when initated with 3 grams of PETN.

EXAMPLE 3

The pre-emulsion and suspension of Example 2 were continuously pumped through a static mixer mounted in the end of a charging hose having a length of 10 m and a diameter of 25 mm. The pre-emulsion was fed centrally into the hose and the suspension in a ring surrounding the pre-emulsion, using the suspension as a lubricant for the pre-emulsion. The final explosive had the same blasting characteristics as in Example 2.

EXAMPLE 4

A solution of 50.0 kg AN, 10.0 kg SN, 10.0 kg water and 0.010 kg tartaric acid was prepared at 75° C. This solution was emulsified in 6.0 kg fuel phase, consisting or 5.0 kg mineral oil and 1.0 kg sorbitanmonooleate, but use of a Votator CR-mixer. Both phases were held at 75° C. during the emulsifying step. The viscosity of the resulting emulsion was about 33000 mPa.s.

Another salt solution cosisting of 10.0 kg AN, 4.0 kg SN, 0.010 kg sodium nitrite and 10.0 kg water was prepared. The pre-emulsion and the second salt solution were mixed at 65° C. in the same ribbon mixer as in Example 1. After a few minutes of rapid gassing the density stabilized at 1.11 g/cc, measured at room temperature. When initiated by 3 g of PETN in 32×550 mm plastic tube, the explosive detonated with a velocity of 3920 m/s.

EXAMPLE 5

Example 4 is repeated at room temperature. After about 12 hours of gassing the density is 1.1 g/cc and the velocity of detonation is about 4000 m/s.

EXAMPLE 6

A pre-emulsion was prepared by emulsifying 70.0 kg AN-solution (83% by weight, crystallization temperature about 79° C.) into 5.5 kg fuel phase consisting of 4.5 kg mineral oil and 1.0 kg sorbitanmonooleate as emulsifier in a Votator CR-mixer at 85° C. The pre-emulsion had a viscosity of 38000 mPa.s at 20° C.

A suspension according to Example 2 was prepared and mixed with the pre-emulsion at 3° C. with the mixing method of Example 3. The final explosive had a density of 1.10 g/cc and shot in a 32×550 mm PVC-tube with a velocity of 4520 m/s when initiated with a cap number 8.

We claim:

1. A method for the preparation of a water-in-oil type emulsion explosive having a discontinuous hydrophilic oxidizer phase, containing oxidizing salts, dispersed in a continuous lipophilic fuel phase, containing combustible materials, and being sensitized by voids dispersed in the emulsion, characterized in that a water-in-oil type pre-emulsion is formed between the fuel phase in a first part of the oxidizer phase at a temperature above the crystallization temperature for the said first part and that a second oxidizer composition, containing a mixture of a second part of the oxidizer phase and the voids or void generating means for the emulsion, is emulsified in the preemulsion at a temperature above the crystallization temperature for the said second part.

2. The method of claim 1, characterized in that the crystallization temperature of the second oxidizer composition is lower than the crystallization temperature of the first part.

3. The method of claim 2, characterized in that the second part of the oxidizer phase has a higher water content than the first part.

4. The method of claim 2, characterized in that the second part of the oxidizer phase contains crystallization point lowering agents or salts of lower crystallization temperature than in the first part.

5. The method of claim 2, characterized in that the crystallization temperature of the second part is lower than the ambient temperature at the site of final emulsion preparation.

6. The method of claim 1, characterized in that the second part is mixed with a chemical foaming agent as void generating means.

7. The method of claim 6, characterized in that the foaming agent mixed with the second part is a component of a double or multiple component chemical foaming system.

8. The method of claim 7, characterized in that an acid is included in the pre-emulsion and nitrite in the second part and that urea or thiourea is optionally present, either in the pre-emulsion or in the second part.

9. The method of claim 1, characterized in that the second part is mixed with hollow particles.

10. The method of claim 9, characterized in that the hollow particles are discrete inorganic microspheres or thermoplastic organic microspheres.

11. The method of claim 1, characterized in that the second oxidizer composition represents between 10 and 70% by volume of the final emulsion.

12. The method of claim 11, characterized in that the second oxidizer composition represents between 30 and 60% by volume of the final emulsion.

13. The method of claim 1, characterized in that the second oxidizer part contains a thickener.

14. The method of claim 1, characterized in that the pre-emulsion and the second oxidizer composition are delivered to a mixing device through a common tube or hose whereby the pre-emulsion is transported centrally and the second oxidizer composition is transported in a liquid ring surrounding the pre-emulsion.

15. The method of claim 14, characterized in that the mixture is ejected directly into a borehole.

16. The method of claim 1, characterized in that the mixing device for preparation of the final emulsion is a static mixer.

17. An oxidizer composition for preparation of water-in-oil type emulsion explosives, characterized in that it contains oxidizing salts, that it has a water content between 15 and 70 percent by weight, that it has a crystallization temperature below 40° C., and that it has a volume content of voids above 30%.

18. The method of claim 3, characterized in that the crystallization temperature of the second part is lower than the ambient temperature at the site of final emulsion preparation.

19. The method of claim 4, characterized in that the crystallization temperature of the second part is lower than the ambient temperature at the site of final emulsion preparation.

20. The method of claim 14, characterized in that the mixing device for preparation of the final emulsion is a static mixer.

21. An oxidizer composition for preparation of emulsion explosives, characterized in that it contains oxidizing salts and water and has a volume content of voids above 40%.

22. The composition of claim 21, characterized by a crystallization temperature below 20° C.

* * * * *